US006200116B1

(12) United States Patent
Schofield et al.

(10) Patent No.: US 6,200,116 B1
(45) **Date of Patent: *Mar. 13, 2001**

(54) VACUUM PUMPS

(75) Inventors: Nigel Paul Schofield, Horsham; Michael Henry North, Reigate, both of (GB)

(73) Assignee: The BOC Group plc, Windlesham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/334,236

(22) Filed: Jun. 16, 1999

(30) Foreign Application Priority Data

Jun. 17, 1998 (GB) ..... 9813048
Jul. 7, 1998 (GB) ..... 9814659

(51) Int. Cl.[7] ..... F01C 1/24
(52) U.S. Cl. ..... 418/194
(58) Field of Search ..... 418/194

(56) References Cited

U.S. PATENT DOCUMENTS 678,570 * 7/1901 Jones ..... 418/194
3,180,559 * 4/1965 Boyd ..... 418/194
4,405,286 * 9/1983 Studer ..... 418/194
4,952,125 * 8/1990 Nagai ..... 418/194
4,963,079 * 10/1990 Fujiwara et al. ..... 418/83
6,019,586 * 2/2000 Liou ..... 418/194

FOREIGN PATENT DOCUMENTS

384355 * 12/1932 (GB) ..... 418/194
59-208077 * 11/1984 (JP) ..... 418/194
0267384 * 10/1989 (JP) ..... 418/194

* cited by examiner

*Primary Examiner*—Thomas Denion
*Assistant Examiner*—Theresa Trieu
(74) *Attorney, Agent, or Firm*—Salvatore P. Pace

(57) ABSTRACT

A vacuum pump incorporating a screw mechanism section and comprising two externally threaded rotors mounted on respective shafts in a pump body. The externally threaded rotors are adapted for counter-rotation in a first chamber within the pump body with intermeshing of the rotor threads in order to pump gas from a pump inlet by action of the rotors. The root diameter of each rotor increases and the thread diameter of each rotor decreases in a direction from pump inlet and in which the gas is pumped. The two externally threaded rotors are positioned in the pump body by means of shaft bearings located inside cavities in the rotors. The cavities are sealed at the ends closest to the pump inlet.

3 Claims, 2 Drawing Sheets

VACUUM PUMPS

BACKGROUND OF THE INVENTION

This invention relates to oil free (dry) vacuum pumps and, more particularly to such pumps having a screw rotor mechanism.

A screw pump comprising two externally threaded or vaned rotors mounted in a pump body and adapted for counter-rotation in the body with intermeshing of the rotor threads is well known. Close tolerances between the rotor threads at the points of intermeshing and with the internal surfaces of the pump body causes volumes of gas being pumped between an inlet and an outlet to be trapped between the threads of the rotors and the internal surface of the pump body and thereby urged through the pump as the rotors rotate.

Such screw pumps are potentially attractive because they can be manufactured with few working components and they have an ability to pump from a high vacuum environment at the pump inlet down to atmospheric pressure at the pump outlet.

Screw pumps are generally designed with each screw rotor being of cylindrical form overall, with the screw thread tip cross section being substantially constant along the length of the rotor. This has a disadvantage in vacuum pumps in particular that no volumetric compression is generated in use of the pump along the length of the rotor, thereby detrimentally affecting the pump's power consumption.

Screw vacuum pump s are commonly used in the semiconductor industry and, as such, need to be capable of maintaining a clean environment associated with semiconductor device processing, especially in that area of the pump—the pump inlet—closest to the semiconductor processing chamber to which the pump is attached.

A disadvantage associated with screw pumps in general is that the relatively long screw rotor length of vacuum pumps is that they need to have their rotor shafts held in bearing at each end of the shaft, i.e. including the end associated with the pump inlet. As such, the lubricants necessarily associated with these bearings may tend to leak upstream of the gas flow through the pump and thereby contaminate the semiconductor chamber to which it is attached.

The invention is concerned with overcoming such disadvantages and to provide a screw pump with improved power consumption coupled with improved lubricant containment.

SUMMARY OF THE INVENTION

In accordance with the invention, there is provided a vacuum pump incorporating a screw mechanism section and comprising two externally threaded rotors mounted on respective shafts in a pump body and adapted for counter-rotation in a first chamber within the pump body with intermeshing of the rotor threads to pump gas from a pump inlet by action of the rotors, wherein the root diameter of each rotor increases and the thread diameter of each rotor decreases in a direction from pump inlet and in which the gas is pumped, and wherein the rotors are positioned in the pump body by means of shaft bearings inside cavities in the rotors and sealed at the ends closest to the pump inlet.

Pumps of the invention provide the advantage that a volumetric compression is generated along the length of the screw mechanism (from chamber inlet to outlet) without the need to use end ports which are commonly used in air compressors. The purpose of such volumetric compression is to minimize the size of the exhaust stage of the screw section, thereby keeping the power consumption to a minimum whilst maintaining a good inlet size so as to allow faster evacuation of the chamber being pumped and faster inlet speeds of the gas being pumped. It also makes it easier for powders and other debris to be pumped without clogging the mechanism. In addition, the presence of bearings inside the rotors—the bores being typically half the length of the rotor—allows the inlet end of the tapered rotors to be machined to a greater depth (smaller diameter) than normal bearings would permit.

As such, the conjugate thread on the opposite rotor can therefore have a correspondingly larger diameter, all of which allow the pump inlet volume to be maximized.

In order for the pump to possess an increasing root diameter and a decreasing thread diameter in the screw section, the respective cavities or bores within the pump body—whose surfaces form the pump stator and which in cross se represented by a "figure of eight" configuration (see later)—will taper from the inlet to the outlet.

However it is clear that a decreasing thread diameter and an increasing root diameter causes the nominally annular spaces defined between successive threads of each rotor through which the gas being pumped passes in turn during operation of the pump to decrease from pump inlet to pump outlet. As such, gas passing through the pump will increasingly be compressed.

In addition, the external taper caused by the increasing root diameter of the rotors (from pump inlet to pump outlet) generally allows the cavities inside the rotors to be correspondingly tapered. In preferred embodiments, the invention allows, by virtue of the internal taper, for a sufficiently rigid bearing support structure to be present in the internal cavity. Such a bearing support can be made sufficiently rigid to resist bending stresses at the pump inlet end of the rotor/shaft arrangement.

In addition, the tapered rotor allows the bearing support structure to have a greater diameter and thickness at its driven end (the pump outlet end), reducing to a smaller diameter and thickness further along its length as it extends in to the bore in the tapered rotor.

The bearing supports for the internally positioned bearings may all be fixed to a head plate of the pump in the normal manner or, alternatively and preferably, may be fixed to the pump body independently of each other.

BRIEF DESCRIPTION OF THE DRAWINGS

To illustrate the invention, and to show how it may be put in to effect, reference will now be made, by way of exemplification only, to the accompanying drawings in which.

DETAILED DESCRIPTION

Figure 1:
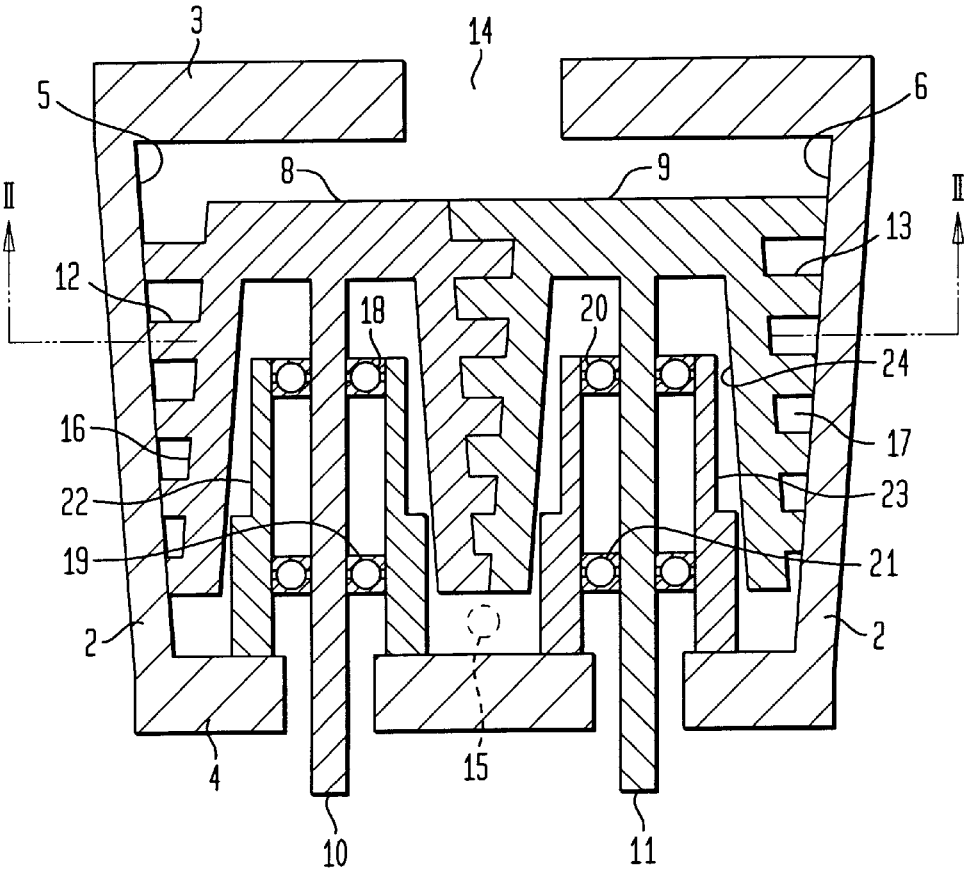
FIG. 1 is a schematic cross-sectional view through a vacuum pump according to the invention.

With reference to the drawings, FIG. 1 shows a vacuum pump of the invention comprising a body 2 also having a top body portion 3 and a lower body portion 4.

Figure 2:
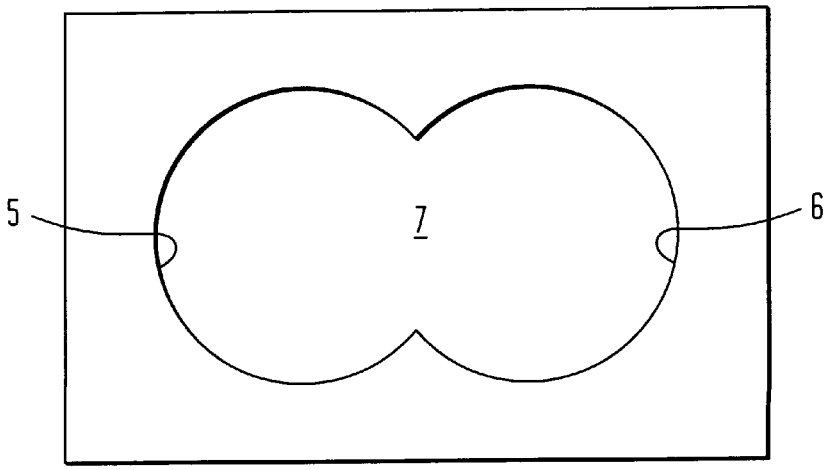
FIG. 2 is a schematic cross-sectional view of the vacuum pump of FIG. 1 along the line II—II of FIG. 1 and showing only the shape of the bores of the pump.

The body 2 defines two internal bores 5, 6 which are linked at the center to form an internal "figure of eight"

shaped cavity 7 as shown generally in FIG. 2. The cross-section of the bores and the cavity taper and decrease gradually in a direction from pump outlet to pump inlet. Each cavity is sealed at its end closest to the pump inlet.

Positioned in the internal bores 5, 6 are two rotors 8, 9 respectively which are attached to shafts 10, 11 respectively. The shafts/rotors are adapted for rotation about their main axes by means of a motor (not shown) driving the shaft 10 and by means of the shaft 11 being connected to the shaft 10 by gears (not shown) such that the shafts rotate in opposite direction but at the same speed of rotation.

The rotors 8, 9 are of generally cylindrical shape and have on their outer surface a continuous helical vane or screw thread 12, 13 respectively which intermesh with each other at the center of the cavity 7.

A pump inlet 14 is formed in the top portion 3 and a pump outlet 15 is present above the lower portion 4 and extending through the body 2 in a generally radial direction.

Figure 3:
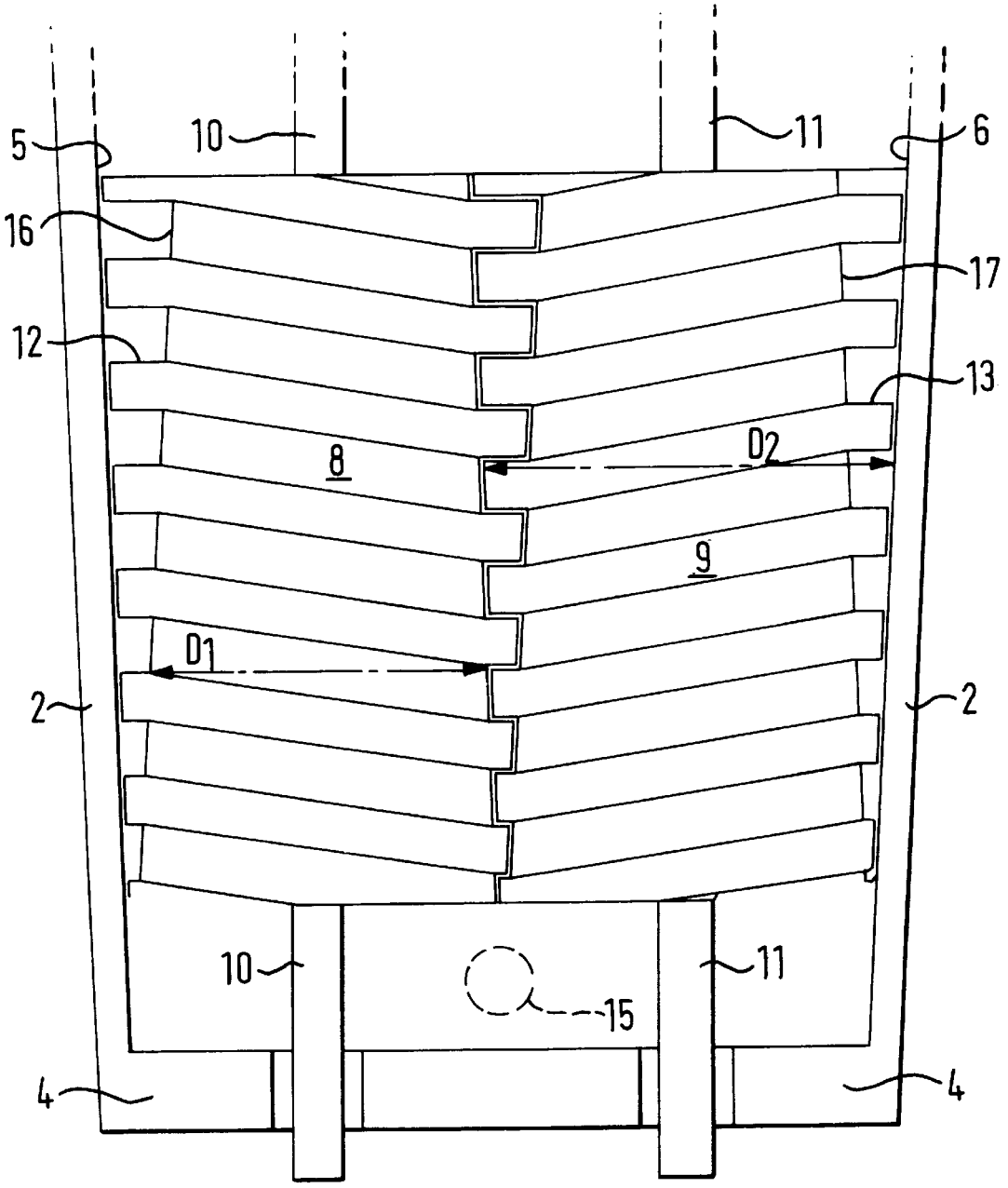
FIG. 3 is a schematic view of the screw pump rotors of the pump of FIG. 1.

With particular reference to FIG. 3, each rotor 10, 11 comprises a root portion 16, 17 respectively, the root diameter $D_1$ of which increases gradually in a direction from the pump inlet to the pump outlet and a thread portion 12, 13 respectively, the thread diameter $D_2$ of which decreases gradually again in the direction from the pump inlet to the pump outlet.

In use of the pump, rotation of the shafts 10, 11 as described above causes rotation of the attached rotors within the bores 5, 6 and the positioning of the shafts/rotors is such that the threads 12, 13 intermesh with close tolerances therebetween and with the sides of the bores 5, 6, all in a manner known per se in respect of vacuum pumps in general.

Fluid to be pumped will pass through the inlet 14 and will be pumped (and compressed) by the rotating rotors down the length of the rotors and in to the space at the base (as shown) of the rotors above the lower portion 4, exiting from the pump by the outlet 15.

The shafts 10, 11 are held in position between two sets of bearings 18, 19 and 20, 21 respectively. The use in pump of the invention of a tapered rotors and the presence of a corresponding tapered bore 20, 24 in the rotors 10, 11 respectively allows for bearing supports 22, 23 for each set of bearings to be present in the bores and to have a greater diameter and thickness at the end of the shafts 10, 11 nearer the pump outlet 15.

This provides the dual benefit of having the greater diameter and thickness bearing supports at the more critical end of the shafts, i.e. closest to the motor/gears, in terms in particular of rigidifying the shafts in that area, and of having all the bearings in the sealed cavities in the rotors such that no oil or lubricant associated with the bearings can escape and contaminate the pump inlet area which, in use of the pump, is closest to the semiconductor processing.

We claim:

1. A vacuum pump comprising:

a pump body having a screw mechanism section comprising two externally threaded rotors mounted on respective shafts and adapted for counter-rotation in a first chamber within the pump body with intermeshing of the rotor threads to pump gas from a pump inlet by action of the two externally threaded rotors;

each of the two externally threaded rotors having a root diameter increasing and a thread diameter decreasing in a direction from pump inlet and in which the gas is pumped;

the two externally threaded rotors having cavities sealed at ends of the two externally threaded rotors located situated closest to the inlet of the pump; and shaft bearings to position the two externally threaded rotors in the pump body, the shaft bearings located inside the cavities in the rotors.

2. The vacuum pump according to claim 1 in which the shaft bearings are fixed to a head plate of the pump.

3. The vacuum pump according to claim 1 in which the shaft bearings are fixed to the pump body independently of each other.

* * * * *